United States Patent [19]

Schmanski

[11] Patent Number: 4,674,432

[45] Date of Patent: Jun. 23, 1987

[54] TRAFFIC BARRICADE

[75] Inventor: Donald W. Schmanski, Carson City, Nev.

[73] Assignee: Carsonite International Corporation, Carson City, Nev.

[21] Appl. No.: 624,375

[22] Filed: Jun. 22, 1984

[51] Int. Cl.[4] ..... E01F 13/00; E04H 17/14

[52] U.S. Cl. ..... 116/63 P; 116/63 R; 248/548; 248/900; 256/64; 446/107; 446/121

[58] Field of Search ..... 40/610, 612, 903; 116/63 R, 63 P, 63 C; 256/64; 404/6, 9; 24/17 AP, 30.5 P, 16 PB; 340/114 R, 114 B; 411/508–510, 457; 248/165, 166, DIG. 10, 548, 900; 446/107, 120, 121; 272/116, 117, 123, 124

[56] References Cited

U.S. PATENT DOCUMENTS

| | | | |
|---|---|---|---|
| 2,995,847 | 8/1961 | Carpenter | 248/166 |
| 3,015,804 | 1/1962 | Nunn | 116/63 P |
| 3,231,270 | 1/1966 | Winer | 272/123 |
| 3,880,406 | 4/1975 | Stehle et al. | 256/64 |
| 3,917,232 | 11/1975 | Lindner | 404/6 |
| 3,950,873 | 4/1976 | Stehle et al. | 116/63 P |
| 4,029,312 | 6/1977 | Wright | 272/123 |
| 4,071,224 | 1/1978 | Gilbert | 256/64 |
| 4,183,695 | 1/1980 | Wilcox | 404/6 |
| 4,231,676 | 11/1980 | Smith et al. | 404/6 |
| 4,298,186 | 11/1981 | Glass | 256/64 |
| 4,538,806 | 9/1985 | Wilkerson | 272/122 |

FOREIGN PATENT DOCUMENTS

| | | | |
|---|---|---|---|
| 972731 | 10/1964 | United Kingdom | 24/16 PB |

*Primary Examiner*—Charles Frankfort
*Assistant Examiner*—W. Morris Worth
*Attorney, Agent, or Firm*—Thorpe, North & Western

[57] ABSTRACT

A collapsible barricade comprising a rigid cross-member coupled by an elastic joint to at least one pair of rigid legs. The elastic joint is developed by a flexible, elastic, resilient connecting member which is attached at one end to the cross-member and at the other end to the rigid leg in a manner such that the formed elastic joint is capable of stretching under stress to allow the pair of legs and attached cross-member to deform from a sturdy configuration when subjected to an impact by a vehicle or other moving object. The collapsible barricade can then be restored to its sturdy condition by merely repositioning or reattaching the connecting members to the respective legs and cross-member and by repositioning the deformed structure to its original configuration.

14 Claims, 10 Drawing Figures

TRAFFIC BARRICADE

BACKGROUND OF THE INVENTION

1. Field of Invention

This invention pertains to portable traffic barricades used to identify road hazards and give visual warning thereof to road and foot traffic. More particularly, the present invention relates to a portable barricade structure which is capable of surviving an impact without being destroyed or rendered non-reuseable.

2. Prior Art

Roads, highways, sidewalks and other areas of vehicular and foot traffic are frequently subject to maintenance and reconstruction activities. Typically, such maintenance interrupts the traffic pattern and requires a detour from normal traffic flow. Such unexpected changes in driving conditions result in greatly increased risk of accidents and concurrent damage to property and life. For example, 60% of all highway fatalities occur in construction work areas. Accordingly, federal and state laws require adequate delineation of such hazardous conditions.

The principal highway warning device in a construction zone is the traffic barricade. This device comprises a horizontal reflective member which has a large face or surface structure to provide immediate visual recognition during both daylight and nighttime hours. This horizontal member is typically supported by two pairs of legs which are attached to form a type of sawhorse configuration. In high risk areas, a blinking light is attached to the top of the barricade to get the attention of the passing traffic.

Originally, traffic delineators were constructed of wood. A horizontal board was mounted to vertically inclined boards in the referenced sawhorse configuration using nuts and bolts. Such barricades were very vulnerable to vehicle impact, which usually resulted in destruction of the barricades.

Because the wooden legs of the earlier barricades were subject to breakage, angle irons were substituted and attached to the horizontal cross-member using nuts and bolts. The greatly increased strength of the angle iron enabled the barricade to survive many low-speed impacts, but resulted in damage at higher speeds.

Because of these problems, attempts have been made to substitute fiber reinforced plastic legs in place of the angle iron. As with the angle iron, the cross-member and legs are bolted together to form a stiff, unitary structure. Although the fiber reinforced plastic legs were more capable of surviving impact, the cross panel and legs are still rigid and subject to breakage upon high speed impact of 30 miles per hour or more.

In an effort to provide a barricade capable of surviving impact by a vehicle, thermoplastic materials such as polyethelyne have been used to develop a single piece frame representing ½ of the sawhorse structure. These frames were then joined at the top to provide a stable stand. In addition to being very expensive, however, such thermoplastic barricades become brittle in cold weather and warp or sag in extreme heat. When sandbags or other heavy weights are draped over the barricade to stabilize them in winds, the thermoplastic material is often stretched and distorted out of shape.

Because of these and other adverse properties of plastic barricades, the conventional angle iron barricade has remained one of the principal warning devices at highway maintenance sites. This predominance continued despite the fact that the average life for the angle iron barricade is only about ninety (90) days. It is estimated each year that ½ million new barricade units are purchased to replace broken or damaged devices. Accordingly, one skilled in the art is very familiar with the extreme high cost of maintaining serviceable traffic barricades using angle iron legs, bolted to a wood or plastic cross-member as a single, rigid structure.

OBJECTS AND SUMMARY OF THE INVENTION

It is therefore an object of the present invention to provide a traffic barricade which is impact resistent, but which provides a sturdy configuration necessary to survive the adverse conditions of construction work areas.

It is a further object of the present invention to provide a traffic barricade which conforms to state and federal specifications in appearance and structure, which embodies a collapsible concept of survivability in impact situations.

A still further object of the present invention is to provide a traffic barricade which deforms upon impact without resulting in damage to components of the barricade structure.

Yet another object of this invention is to provide a traffic barricade which has its various members coupled together by elastic joints which enable the barricade to deform and dissipate impact energy without causing permanent barricade damage.

A still further object of this invention is to provide a detachable cross-member which includes elastic joints for attachment to various types of legs as part of a traffic barricade.

These and other objects have been successfully achieved in a collapsible barricade structure comprising first and second pairs of rigid legs having substantially equal lengths and including respective top and bottom portions adapted for inclined or vertical orientation. One or more cross-members are provided for horizontal attachment between the top portions of the respective pairs of legs. First attachment means are positioned on the upper portion of at least one of the respective pairs of legs and second attachment means are positioned at respective ends of the horizontal cross-member at locations corresponding to the first attachment means previously referred to on the legs. Flexible, elastic, resilient connecting members having first and second ends are respectively attached (i) at the first end to the first attachment means on the legs and (ii) at the second end to the second attachment means at the ends of the cross-member. These elastic connecting means are adapted to affix the respective ends of the cross-member to the pair of legs in a sturdy configuration under static or non-impacting conditions. The combination of the connecting member and attachment means forms a resilient, elastic joint capable of stretching under stress to allow the pair of legs and attached cross-member to deform from the sturdy configuration into a partially collapsed state. With minor impact, the resilient elastic joints can automatically resume their original configuration following impact. If the impact is severe, the elastic joint permits the barricade to collapse. Following such impact, the connecting members can be repositioned or reattached to the first and second attachment means, restoring the original sturdy configuration for the barricade. Coupling means are provided between the top portions of the respective first and second pair of legs to tie both sides of the barricade together and allow the respective legs to be spread apart in a wedge or sawhorse shaped configuration.

By using the present invention, one achieves the combined advantages of a rigid structure wherein the cross-member and legs are formed of rigid materials to provide strength and durability to the barricade, while at the same time providing for an elastic joint to protect the rigid components from fracture during impact. Other benefits and features will be apparent to those skilled in the art based on the following detailed description taken in conjunction with the drawings which include:

FIG. 1, showing a perspective view of a collapsible traffic barricade structured in accordance with the present invention;

FIG. 1A, illustrating an enlarged view of Item 24 in FIG. 1.

FIG. 2, which shows a cutaway view of an elastic joint utilized to join the rigid leg and rigid cross-member;

FIG. 3, which illustrates the preferred embodiment of a connecting member structured in accordance with the present invention;

FIG. 4, which depicts the connecting member of FIG. 3 in proper attachment to a cross-member;

FIG. 5, which shows an additional embodiment of a connecting member made in accordance with the teachings of the present invention;

FIG. 6, which is a cross-section taken along the line 6—6 of FIG. 5;

FIG. 7, which shows a slotted bracket and coupling pin configuration suitable for coupling opposing sides of the barricade with a light signaling device.

DETAILED DESCRIPTION OF THE INVENTION

Figure 1:
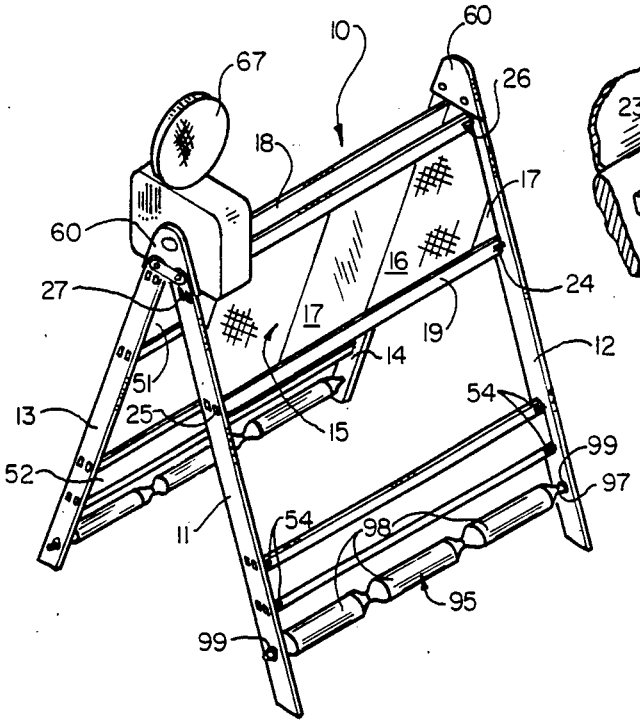

A collapsible barricade 10 is shown in FIG. 1 having a first pair of legs 11 and 12 and a second pair of legs 13 and 14 which are substantially equal in length and are adapted in size and configuration to be capable of being joined at the top to form a barricade structure. The orientation of the respective pairs of legs in FIG. 1 are referred to herein as an inclined vertical orientation, meaning that the legs are upright but slanted to form a wedge shaped structure. As used herein, reference to the lower portion of the legs 11, 12, 13, and 14, pertains to that portion of the legs nearest the ground in a fully spread configuration. The top portion of the legs refers to the upper half portion of the legs closest to the apex or juncture of the leg pairs.

The embodiments illustrated herein utilize rigid components made of fiber reinforced plastic composite because of its impact resistance, stiffness and durability in all weather conditions. The illustrated legs are slatted and turned on edge so that maximum stiffness and strength is developed in the vertical direction to support the weight of the barricade and provide a sturdy structure. From a lateral direction, however, the slatted structure provides greater flexibility to assist in absorbing and dispersing impact energy where the barricade is struck by a vehicle or other moving object. Additional strength can be added by including a rib formed along the longitudinal axis, or by having an angular cross-section. Furthermore, the slatted structure provides the necessary physical surface area to mount horizontal components of the barricade. Mounting structure for these elements is discussed hereafter.

At least one cross-member is required to support the pair of legs 11 and 12. This cross-member 15 is positioned horizontally between the respective legs 11 and 12 and has adequate surface area to provide visual awareness and warning in accordance with state and federal requirements pertaining to barricades. The upper cross-member or support member 15 is fabricated of fiber reinforced plastic composite. Typically, both the legs and cross-member would be fabricated by the pultrusion technique wherein liquid resin and glass fibers are cured to a solid structure having the desired cross-section suited to specific loading and flexibility requirements for the barricade components. For example, the cross-member 15 has a flat web section 16 which is adapted for fixation of reflective material and has a thinner cross-section than the stiffening ribs 18 and 19 located at the edges of the web section 16. These thicker portions of the cross-member 15 are heavily loaded with longitudinal roving to increase the stiffness and strength of this component. This rib section is identified as item 21 in FIG. 4. The web is identified as item 20. The web section 16 includes woven fabric or mat to provide tensile strength in 360 degrees of orientation.

Although the preferred use of fiber reinforced plastics (in particular thermosetting resins) is disclosed herein, it is to be understood that other materials including wood, metal and other plastics could likewise be formed into rigid components of the subject collapsible barricade.

Figure 1A:
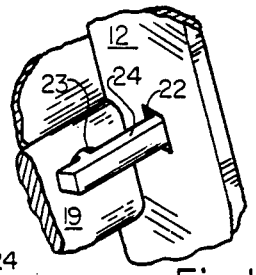

The primary feature of this invention is the method and means for attachment of the rigid structural components such as legs 11, 12, 13 and 14 and cross-member 15. This method is directed toward developing an elastic joint such as is illustrated in the exploded view of FIG. 1A wherein the rib portion 19 of the cross-member 15 is shown in a joined relationship with leg 12 butting at approximate right angles to cross-member 19. This joint includes a first attachment means or opening 22 in leg 12. This first attachment means or opening 22 in leg 12 is comparable to openings 30 in leg 31 of FIG. 2.

A second attachment means which operates in connection with the first attachment means is shown as item 23 on the exploded view of cross-member section 19. This second attachment means is an opening which is positioned at one end of the horizontal cross-member 15 at a location corresponding to the first attachment means and adapting the cross-member for a horizontal attachment between the pairs of legs 11 and 12. Although openings 22 and 23 are shown as the first and second attachment means, it will be apparent to one skilled in the art that other types of fastening structure can be built into the respective cross-member 19 and leg 12 to adapt their joining in accordance with the elastic joint taught by the present disclosure. For example, notches, slots, projecting fingers and other physical structures which are adapted to support an elastic joint may be equally as effective.

The first 22 and second 19 attachment means represent connecting points for attachment of a flexibile, elastic, resilient connecting member 24. A second connecting member 25 would be utilized to attach the opposite end of the cross-member 15 to leg 11. In FIG. 1, a second pair of connecting members 26 and 27 are used and substantially resemble the exploded view of connecting member 24. This connecting member 24 enables the use of rigid legs and cross-member as part of an elastic and flexible structure. The elastic nature of the connecting member 24 applies tension to hold the cross-member 15 and the respective pairs of legs 11, 12, 13 and 14 in a sturdy configuration. By butting the rigid components against each other, the unitary barricade becomes stiff to withstand the buffeting of winds, minor impact, and the positioning of various weights which are typically applied to keep the barricade upright in heavy winds. In addition to having elasticity to draw the rigid members into butting contact, the connecting member must be both flexible and resilient. Flexibility allows the connecting member to deform in response to an impact so that the rigid cross-member and legs may collapse without damage to the rigid components. This is accomplished as the connecting member 24 elongates to allow the leg or cross-member to deform away from its abutting contact. In this manner, the structure deforms at its joints without loading the rigid leg or cross-member with undue stress.

The elastic connecting member must also be resilient such that following collapse of the structure, the connecting member can be repositioned to its original sturdy configuration. In this sense, the connecting member 24 and attachment means 19 and 22 form a resilient, elastic joint, capable of stretching under stress to allow the pair of legs and attached cross-member to be deformed from a sturdy configuration under an impact. Subsequent to this deformation, the elastic joint is restored to its sturdy state by merely repositioning or reattaching the connecting member 24 at the first and second attachment means 22 and 19, and by repositioning the deformed structure to its original sturdy configuration.

Figure 3:
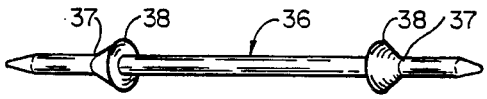
Figure 4:
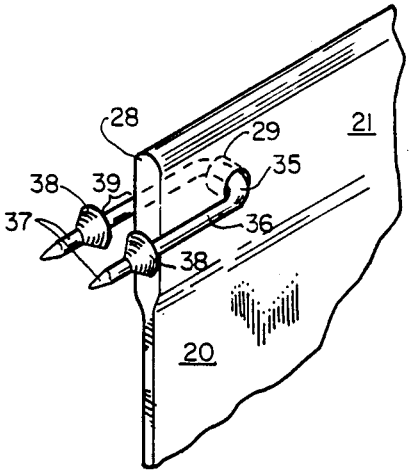
Figure 5:
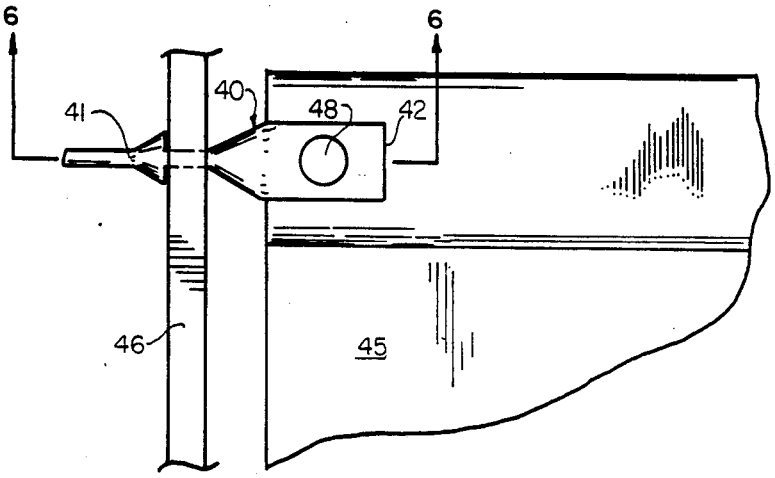
Figure 6:
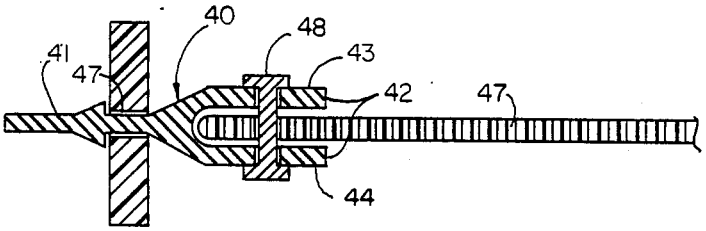

The subject disclosure identifies three (3) embodiments of a connecting member designed in accordance with the present invention. The connecting member 24 previously discussed is more clearly shown as item 32 in FIG. 2. FIG. 3 shows the preferred connecting member 36 which would be positioned as shown in FIG. 4. Finally, FIGS. 5 and 6 show an additional connecting member 40 which spaces the cross-member 45 away from the rigid leg 46 for support in its horizontal position.

Figure 2:
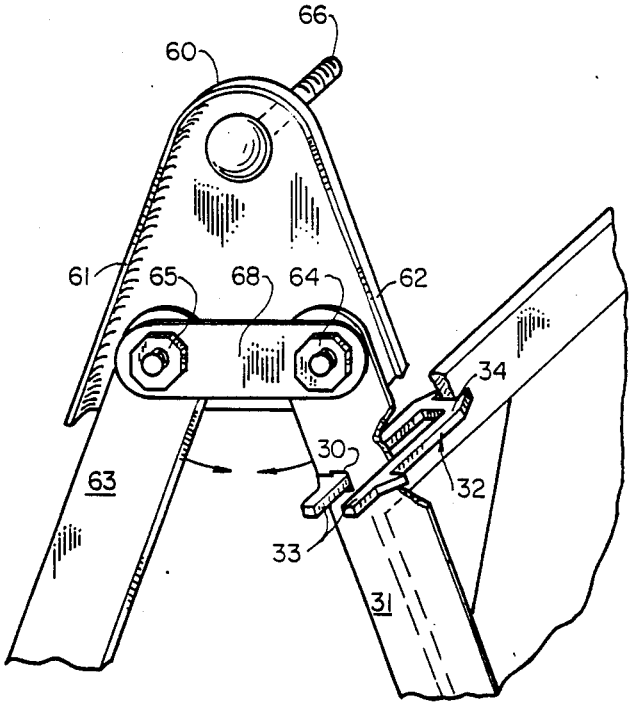

For purposes of general definition of the connecting member, the structure can be divided into two parts. These parts are the first end and second end, representing the parts of the connecting member to be attached at the first and second attachment means previously described. The first end is that end to be attached to the first attachment means which is found on the legs of the barricade. In FIG. 2 for example, the first end of the connecting member 32 is item 33. This first end 33 actually comprises an enlarged end, head or stop which prevents the elastic connecting member from being pulled free from the leg structure 31. It is apparent from the drawing that the first attachment means 30 must be smaller than the first end 33 of the connecting member in order for the latter to be retained in its place.

In the embodiment of FIGS. 3 and 4, the first end comprises the extremities 37 of the connecting member 36, including the enlarged head or stop 38 which butts against the leg structure which would be positioned between the edge of the cross-member 28 and the inside face of head 38. Although the leg structure has been omitted from FIG. 4, its position is represented by item 39.

The two embodiments of connecting member illustrated in FIGS. 2 and 4, illustrate a general category of connecting members which comprise U-shaped members having opposing open ends 33, 37 and closed ends 34 and 35 as the first and second ends attached at the legs and support members respectively. In these instances, the first ends 33 and 37 of the U-shaped members 32 and 36 had the legs of each U being removably attached to the top portions of the pair of rigid legs of the barricade.

FIGS. 5 and 6 illustrate the case where the first end 41 of the connecting member 40 forms the closed end of the U-shaped member. In this instance, element 41 includes a finger or projection adapted for insertion through the first attachment opening 47 in the rigid leg. As can be noted from the drawing, the finger 41 has a distal end which includes a head larger in size than the first opening 47 to retain the first end of the U-shaped member inserted at the top of the leg during stress which might be applied upon impact or deformation of the barricade. Hereagain, other geometric configurations for the connecting member wherein the first end comprises the closed end of the U are envisioned.

Returning to a general description of the connecting member, the second end refers to the part of the connecting member attached to the second attachment means which is located on the cross-member of the barricade such as item 23 in FIG. 1. In FIGS. 1 through 4, the second end of the connecting member comprises the closed end of the U-shaped structure which is inserted through the second attachment means on the crossmember. In FIG. 2, the second end is element 34 which is inserted through an opening similar to item 23 in FIG. 1. In FIG. 4, the second end comprises item 35 which is inserted through an opening 29 in the cross-member portion 21. On the other hand, FIGS. 5 and 6 illustrate a connecting member wherein the second end 42 comprises the open end of the U, with the legs of the U 43 and 44 being attached to the crossmember. FIG. 6 illustrates the positioning of the cross-member 47 between the extending legs or fingers 43 and 44 of the connecting member. These fingers and the cross-member have openings aligned for insertion of a retaining pin 48. In this embodiment, the retaining pin 48 and aligned openings through which the pin is inserted comprise the second attachment means.

The elastic connecting means described herein may be fabricated of numerous types of materials, including rubber and synthetic elastomers. An example of such material is uv stabilized, 80 durometer neutral rubber with 300% elongation and 3000 PSI tensile strength. As illustrated in FIG. 1, an additional cross-member 50 can be attached at the lower portion of the pair of legs 11 and 12 utilizing the reference elastic connecting members 54. Similarly, the second pair of legs 13 and 14 can be supported by cross-members 51 and 52 having comparable elastic connecting means. It is apparent to one skilled in the art that FIG. 1 illustrates the preferred embodiment wherein all of the cross-member 15, 50, 51 and 52 are attached to the respective pairs of legs 11, 12, 13 and 14 by elastic connecting means.

The respective forward and rearward sides of the barricade 10 are joined at the top by a brace or coupling means 60 which is attached between the upper portions of the respective first and second pair of legs. This brace 60 is adapted with means which permit the bottom portion of the respective pairs of legs to be spread apart in a wedge shape configuration as shown. FIG. 2 gives greater detail for the brace structure and illustrates the use of lateral flanges 61 and 62 which allow the legs 31 and 63 to be spread apart until the leg structure butts against the flange structure 61 and 62. The legs can be folded together because of pivotal attachment about mounting bolts 64 and 65. This brace 60 also serves as a support base for mounting a light signaling device 67 by means of a bolt 66 which can be positioned into a threaded opening of the light signal 67.

Figure 7:
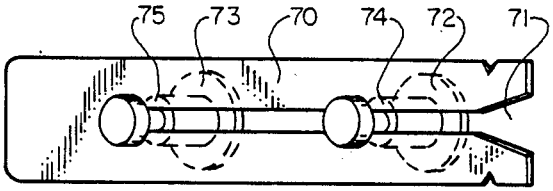

FIG. 7 illustrates another embodiment for coupling means for attaching the top portion of the first and second pair of legs to a brace such as shown as item 60. This coupling means comprises a mounting plate 70 which corresponds to plate 68 in FIG. 2. This plate distributes stress and load applied to the ends of the fiberglass legs 31 and 63 and avoids wear and tear on the legs by virtue of vibrational and rotational contact between the bolt 64 and the fiberglass material. Mounting plate 70 has a slotted opening 71 which is adapted to fit a pair of bolts 72 and 73 which include a recessed channel 74 and 75, wherein the channel is sized to fit the thickness and configuration of the brace and slotted portion thereof. The respective legs of the barricade would be positioned between the heads of the bolts 72 and 73 (shown in phantomline) and the opposite face of the plate 70. It would be apparent to one skilled in the art that the cross-member 15 with its elastic connecting members can be attached to barricade legs constructed of various different materials.

Indeed, the barricade need not be a sawhorse structure. It may be attached to any type of support structure in which the utility of the elastic joint is significant. From this perspective, the subject invention can be viewed as a detachable cross-member for providing traffic delineation or notice of road hazard as part of a self-supported traffic control device. The detachable cross-member comprises an elongated, rigid support plate having at least one face with substantial surface area adapted for receiving reflective material responsive to vehicle headlights. At least one pair of flexible, elastic, resilient connecting members having first and second attachment ends are included. The pair of second attachment ends are coupled to respective ends of the support plate. The pair of first ends of the connecting members are adapted for attachment to a pair of rigid legs or other support structure to which the detachable cross-member is to be connected. The attachment of the second attachment ends to the support plate is such that the first pair of attachment ends are positioned in an extended, free condition to form an elastic joint capable of stretching when coupled to the legs or support structure in accordance with the teachings of the present invention. This aspect of the present invention is illustrated by FIG. 4 which shows one corner of the detachable cross-member 21, with one of the elastic connecting members 36 positioned at the upper lefthand corner thereof. The preferred embodiment of this detachable cross-member would include three (3) additional connecting members at each of the three remaining corners. Each of these corners would be attached to stiff legs which are adapted to receive the free end (first attachment end 37).

Figure 8:
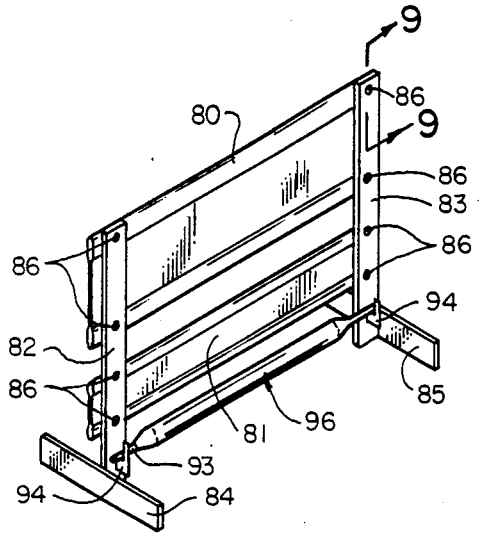
FIG. 8, illustrates a type III barricade with one pair of vertical legs.
Figure 9:
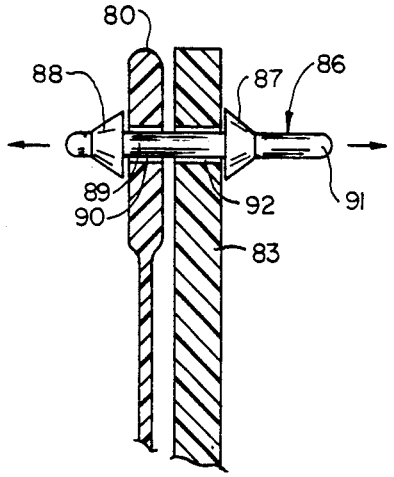
FIG. 9, shows an enlarged sectional view of FIG. 8 taken along Lines 9—9.

The benefit of such a detachable cross-member is illustrated in FIGS. 8 and 9. In this instance, detachable cross-members 80 and 81 have been coupled to a pair of upright legs or supports 82 and 83 to form a Type III barricade which only has one pair of legs. These legs are connected to base members 84 and 85 for vertical support. The cross-members 80 and 81 are attached to the legs 82 and 83 by elastic connecting members 86, which form the desired elastic joints.

FIG. 9 shows one embodiment of a connecting member 86 adapted for the face-to-face attachment of the leg and cross-member illustrated. This elastic member 86 would be preattached to the cross-member 80. Because of the large heads 87 and 88, the connecting member could not be easily removed. The narrower stem 89 would remain in its inserted position through its second attachment means 90 which comprises an opening through the cross-member. To attach the cross-member to the legs 82 and 83, an extended distal end 91 is inserted through an opening 92 (first attachment means) in the leg 83. This end 91 must be sufficiently long to pass through the opening 92 such that the cross-member 80 and leg 83 are mounted on the same stem 89 in face-to-face positioning. The head is held in place by the larger blocking face which butts against the leg 83. It should be noted that the first ends previously disclosed as items 33, 37 and 41 also have an extended finger to facilitate pulling the first end through the respective openings.

The present invention permits the cross-member to be attached at an interior side of the sawhorse structure of FIG. 1, rather than on the forward part of the slatted legs 11 and 12. This interior mounting provides protection of the cross-member and reflective sheeting when the barricade is blown or knocked over. Instead of skidding on the face of the cross-member, contact at the pavement occurs at the rails of the legs 11 and 12. Therefore, in addition to preserving the life of the rigid structure, the present invention offers substantial improvements to survivability of the reflective sheeting.

To further prevent damage to the barricade, weighted cross-members 95 (Fi9. 1) and 96 (FIG. 8) are attached at the base of the barricade. FIG. 1 illustrates a three-section cross-member 95 which comprises a fiberglass rod 97 which is inserted through hollow tubes 98 filled with sand or other heavy substance. The ends of the rods are then inserted into holes 99 as the legs 11 and 12 are spread apart. In the case of FIG. 8, the weighted cross-member 96 comprises a single, sand-filled tube which is positioned on a rod 93. This rod is journaled in a notch 94 positioned at the base of the legs 82 and 83.

This feature of the invention can generally be described as a weighted cross-member comprising an elongated support member 93 or 97 having a length greater than the distance between the respective supporting legs 11, 12 or 82, 83. This length insures that the support member or rod remains in place during static conditions. The support member must also be capable of supporting the total weight of the cross-member 95 or 96 without substantial sagging which might dislodge the device from its journaled position. At least one weighted tube having closed end sections is inserted over the support rod, leaving the ends of the rod free for attachment to the legs. The ends of the weighted tube are closed to form a close fit around the rod to retain sand or other heavy filler within the tube.

This method and structure for weighting a barricade have numerous advantages over prior art techniques which relied upon sand bags draped over the barricade. For example, no obstruction of reflective material occurs. Whereas sand bags fall free of the barricade and must be replaced upon impact or being blown over, the present structure normally remains integrated with the barricade. Furthermore, the weighted cross-member can be positioned very close to the ground to provide the most stable support, rather that at higher cross-members where the center of gravity becomes more precarious. Other advantages and features will be apparent to one skilled in the art, as will equivalent structure. It is therefore to be understood that the scope of the present invention is not to be limited by the previous examples, but is defined by the following claims.

I claim:

1. A collapsible barricade comprising:

a. at least one pair of rigid legs having substantially equal lengths and including respective top and bottom portions and being adapted for generally upright orientation;

b. at least one rigid cross-member adapted for horizontal orientation and attachment between the top portions of the legs;

c. first attachment means positioned on upper portions of the legs;

d. second attachment means positioned at respective ends of the horizontal cross-member at locations corresponding to the first attachment means and adapting the cross-member for horizontal attachment between the first attachment means;

e. at least one pair of separate flexible, elastic, resilient connecting members respectively inserted (i) at a first end to the first attachment means on the rigid legs and (ii) attached at a second end to the second attachment means at the ends of the rigid cross-member to join the pair of rigid legs in a sturdy configuration under static conditions;

f. each said connecting member and respective attachment means forming a flexible resilient, elastic joint between said rigid legs and said rigid cross-member capable of stretching under stress to allow the pair of rigid legs and attached rigid cross-member to deform from the sturdy configuration under an impact and which can be subsequently restored to the configuration sturdy by merely repositioning or reattaching the connecting members at the first and second attachment means and by repositioning the deformed structure to the original sturdy configuration.

2. A barricade as defined in claim 1, further comprising a second pair of rigid legs and leg coupling means attached at top portions of said first and second pairs of legs, said leg coupling means being adapted with means which permit bottom portions of the second pair of rigid legs to be spread apart in a wedge shaped configuration with respect to the first pair of rigid legs.

3. A barricade as defined in claim 1, further comprising a rigid bottom cross-member, said bottom cross-member being coupled between bottom portions of the rigid legs by first and second bottom attachment means;

said barricade further comprising at least one second pair of separate flexible, elastic, resilient connecting members respectively attached (i) at a first end to the first bottom attachment means on the bottom portion of the legs and (ii) attached at a second end to the second bottom attachment means on the bottom cross-member, said second pair of connecting members being adapted to affix respective ends of the bottom cross-member to the pair of legs in a sturdy configuration;

said second pair of flexible connecting members and bottom attachment means forming a resilient, elastic joint capable of streching under stress to allow the pair of rigid legs and attached rigid cross-members to deform from the sturdy configuration under an impact and which can be subsequently restored to the sturdy state by merely repositioning or reattaching the connecting members at the first and second attachment means and by repositioning the deformed structure to the original sturdy configuration.

4. A barricade as defined in claim 2 wherein the second pair of legs includes an upper cross-member attached at top portions of the second pair of rigid legs by separate flexible, resilient, elastic connecting members.

5. A barricade as defined in claim 1 wherein the said at least one pair of separate elastic, connecting members have a U-shape with opposing open and closed ends as first and second ends which are attached at the first attachment means on the legs and at the second attachment means of the cross-member.

6. A barricade as defined in claim 5 wherein the first end of the U-shaped member comprises the open end of the U with respective legs of the U being removably attached to top portions of the pair of rigid legs of the barricade, the second end comprising the closed end of the U-shaped member which is inserted through the second attachment means comprising an opening in the cross-member.

7. A barricade as defined in claim 6 wherein the first attachment means comprises a pair of openings in the top portion of the legs, said first, open end of the U-shaped connecting member being compressibly inserted through the openings in said top portion of the legs and further including deformable stops on the first, open end thereof which are larger than the leg openings to releasably retain the first, open end or said U-shaped connecting member in said openings when the connecting member is deformed during an impact.

8. A barricade as defined in claim 5 wherein the second end of the U-shaped member comprises the open end of the U with legs of the U being attached to the cross-member, the first end comprising the closed end of the U which is inserted through an opening comprising the first attachment means in the top portion of the pair of legs.

9. A barricade as defined in claim 8, wherein the first, closed end of the U-shaped member includes a finger projection adapted for insertion through the first attachment opening, the finger having an extended distal end which includes a head larger in size than the first opening to releasably retain the first end of the U-shaped member inserted in the attachment openings of said rigid legs during deformation resulting from an impact.

10. A barricade as defined in claim 8, wherein the second, open end of the U-shaped member is adapted for insertion of the cross-member between extending fingers of the U, the fingers and cross-member having openings therein adapted for alignment, said barricade further including a retaining pin inserted through the finger and cross-member openings.

11. A barricade as defined in claim 2, further comprising light coupling means for attaching a light signalling device at the top of said pairs of legs to adapt the barricade for night use.

12. A barricade as defined in claim 11, wherein the leg coupling means attached between the respective first and second pair of legs also comprises the light coupling means for attaching the signalling device, said coupling means comprising a mounting plate having a pair of openings for bolting one side of the respective legs thereto, said mounting plate having a third opening adapted for retaining a mounting bolt for attachment of the signalling device, the coupling means further including a bracket adapted for positioning a remaining, opposite side of the legs from the mounting plate such that the legs are rigidly secured between the mounting plate and bracket to prevent the signalling device from being wrenched from the barricade during the impact.

13. A detachable cross-member for providing traffic delineation and visual notice of a road hazard and being adapted for horizontal attachment between upright legs as part of a self-supported traffic control device, said member comprising:

an elongated, rigid support plate having openings at each side for attachment and at least one face with substantial surface are adapted for receiving reflective material responsive to vehicle headlights for giving warning to on-coming traffic;

at least one pair of separate flexible, elastic, resilient connecting members having first and second attachment ends wherein (i) the second attachment ends are coupled to said openings of the support plate and operate to position the first pair of attachment ends in an extended, free position, (ii) said first attachment ends of the connecting members being adapted for attachment to a pair of rigid legs which support the detachable cross-member in a horizontal, sturdy configuration;

said first attachment ends including an extended distal end adapted for inserting through openings in the pair of legs to facilitate pulling the first attachment ends through the said openings in said pair of rigid legs to a seated position against the legs;

the separate, flexible connecting members and plate attachment means forming a resilient, elastic joint between said pair of rigid legs and said rigid support plate capable of stretching when subjected to conditions of stress to allow the pair of legs and attached detachable cross-member to deform from said sturdy configuration under impact without damaging the rigid legs or support plate and which can be subsequently restored to the sturdy configuration by merely repositioning or reattaching the first and second attachment ends of the resilient, flexible connecting members at the rigid legs and support plate attachment means respectively and by repositioning the deformed structure to the original, sturdy configuration.

14. A barricade as defined in claim 1 further comprising a weighted cross-member adapted for attachment at a base portion of a traffic barricade, said weighted cross-member comprising:

an elongated support member having a length greater than the distance between supporting legs of the barricade to which the weighted cross-member is to be attached, said support member having sufficient strength to support the weighted cross-member without substantial sagging;

at least one weighted tube having closed end sections which adapt the tube for mounting on the elongated member, said closed end sections being configured to form a close fit around the elongated member to thereby retain sand or other heavy substance therein.

* * * * *